US008147190B2

(12) United States Patent
Tsypkaykin et al.

(10) Patent No.: US 8,147,190 B2
(45) Date of Patent: Apr. 3, 2012

(54) GUIDE VANE HAVING HOOKED FASTENER FOR A GAS TURBINE

(75) Inventors: Igor Tsypkaykin, Turgi (CH); Beat Von Arx, Trimbach (CH); Christoph Nagler, Zurich (CH)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 12/884,875

(22) Filed: Sep. 17, 2010

(65) Prior Publication Data

US 2011/0016875 A1 Jan. 27, 2011

Related U.S. Application Data

(63) Continuation of application No. PCT/EP2009/051883, filed on Feb. 18, 2009.

(30) Foreign Application Priority Data

Mar. 19, 2008 (CH) ..... 416/08

(51) Int. Cl.
*F04D 29/54* (2006.01)

(52) U.S. Cl. ..... 415/191; 415/208.2

(58) Field of Classification Search ..... 415/134, 415/191, 208.1, 209.2, 209.3
See application file for complete search history.

(56) References Cited

U.S. PATENT DOCUMENTS 3,628,880 A 12/1971 Smuland
4,573,865 A 3/1986 Hsia et al.
4,687,413 A * 8/1987 Prario ..... 415/190
4,820,116 A 4/1989 Hovan et al.
5,201,846 A 4/1993 Sweeney
5,454,220 A 10/1995 Althaus et al.
6,062,813 A 5/2000 Halliwell et al.
6,951,447 B2 * 10/2005 Cherolis et al. ..... 416/193 A (Continued)

FOREIGN PATENT DOCUMENTS

DE 10 2004 004 014 A1 8/2005

(Continued)

OTHER PUBLICATIONS

International Search Report (PCT/ISA/210) issued on Jun. 10, 2009, by European Patent Office as the International Searching Authority for International Application No. PCT/EP2009/051883.

(Continued)

*Primary Examiner* — Nathaniel Wiehe
(74) *Attorney, Agent, or Firm* — Buchanan Ingersoll & Rooney PC

(57) ABSTRACT

A stator vane for a gas turbine includes a vane airfoil which extends in the longitudinal direction of the vane and which is delimited by a leading edge and a trailing edge, and also an outer platform, the inner side of which is exposed to the hot gas which flows through the gas turbine, and on which provision is made for a hook-like fastening element, projecting outwards in the region of the trailing edge, for fastening the stator vane on a casing of the gas turbine, which fastening element, on its side facing the trailing edge, has a locating slot above the trailing edge for the fixing of a heat shield which adjoins the outer platform of the stator vane in the flow direction of the hot gas. Provision is made on the outer platform of the stator vane between the locating slot and the trailing edge of a structure for reducing the thermal and mechanical stresses in the region of the transition between trailing edge and outer platform.

6 Claims, 2 Drawing Sheets

U.S. PATENT DOCUMENTS

| | | | | |
|---|---|---|---|---|
| 2004/0018082 | A1 | 1/2004 | Soechting et al. | |
| 2004/0223846 | A1 | 11/2004 | Taylor et al. | |
| 2007/0172349 | A1* | 7/2007 | Abgrall et al. | 415/191 |
| 2007/0269313 | A1* | 11/2007 | Nadvit et al. | 416/193 A |

FOREIGN PATENT DOCUMENTS

| | | | |
|---|---|---|---|
| EP | 0 844 369 | A1 | 5/1998 |
| EP | 0 620 362 | B1 | 2/1999 |
| EP | 1 384 855 | A2 | 1/2004 |
| EP | 1 475 515 | A2 | 11/2004 |
| GB | 1 322 801 | | 7/1973 |
| JP | 11-050806 | A | 2/1999 |

OTHER PUBLICATIONS

Swiss Search Report dated Jun. 7, 2009 (with English translation of category of documents).

Franz Joos et al., "Field Experience of the Sequential Combustion System for the ABB GT24/GT26 Gas Turbine Family", IGTI/ASME 98-GT-220, 1998, pp. 1-8, Stockholm.

* cited by examiner

GUIDE VANE HAVING HOOKED FASTENER FOR A GAS TURBINE

RELATED APPLICATIONS

This application claims priority as a continuation application under 35 U.S.C. §120 to PCT/EP2009/051883, which was filed as an International Application on Feb. 18, 2009 designating the U.S., and which claims priority to Swiss Application 00416/08 filed in Switzerland on Mar. 19, 2008. The entire contents of these applications are hereby incorporated by reference in their entireties.

FIELD

Gas turbines are disclosed, such as gas turbines having a stator vane.

BACKGROUND INFORMATION

Gas turbines with sequential combustion are known and have been proved to be successful in industrial use. Such a gas turbine, which has been known among experts as GT24/26, follows for example from an article by Joos, F. et al., "Field Experience of the Sequential Combustion System for the ABB GT24/GT26 Gas Turbine Family", IGTI/ASME 98-GT-220, 1998 Stockholm. In this document, FIG. 1 shows a basic construction of such a gas turbine, and FIG. 1 is reproduced in the present disclosure as FIG. 1. Furthermore, such a gas turbine follows from EP-B1-0 620 362.

The stator vanes 10 of the FIG. 1 gas turbine have a vane airfoil 11 which extends in the longitudinal direction and which is delimited in the flow direction of the hot gas (parallel arrows in FIG. 1) by a leading edge 14 and a trailing edge 15. In the longitudinal direction, the vane airfoil 11 is delimited by a vane tip 13 and an outer platform 12 (sometimes also referred to as a shroud, wherein this element in the following text is referred to as an outer platform). The vane tip 13 delimits the annular hot gas passage of the turbine on the inner side and can adjoin the rotor shaft of the turbine via a sealing segment. The outer platform 12, by its inner side 19, delimits the hot gas passage on the outside.

On the outer side of the outer platform 12, which is exposed to throughflow by a cooling medium (for example cooling air), a front and rear hook-like fastening element 16 or 17 are formed, which on the one hand serve for the fastening of the stator vane 10 on the inner casing of the turbine and on the other hand are made available for the locating and fixing of adjacent heat accumulation segments ("heat shields". See FIG. 2, pos. 24) in the flow direction. For this purpose, on the rear fastening element 17 provision is made for a locating slot 18 into which a heat shield can be inserted. The locating slot 18 is delimited towards the outer platform 12 by a horizontal base surface 18' which together with the inclined inner side 19 of this outer platform 12 forms a wedge-shaped section 19' in the region of the trailing edge 15, which section is characterized by a large material volume.

The transition 21 between the trailing edge 15 of the stator vane 10 and the outer platform 12 represents a region which can affect the service life of the stator vane 10 since a high thermal stress, which results from a thermal-mechanical mismatch between outer platform 12 and vane airfoil 11, is established within it, wherein this can lead to a peak in the mechanical stress, which results from the stress of the vane airfoil 11 which is impinged upon by the hot gas flow, being superimposed. The large material volume, which is mentioned above, in the wedge-shaped section 19' above the trailing edge 15 can lead to a significant increase of the thermal stresses in this region which can be important for the service life of the stator vane 10 and therefore lead to a reduction of the service life itself, bearing in mind the fact that modern gas turbines involve high temperatures in respect to operating fluids, which in many cases lie beyond the permissible material temperature of economically usable materials.

SUMMARY

A stator vane for a gas turbine is disclosed, which stator vane comprises: a vane airfoil which extends in a longitudinal direction of the stator vane and is delimited by a leading edge and a trailing edge; an outer platform, an inner side of which is positioned for exposure to turbine gas, and on which at least one hook-like fastening element projects outwards in a region of the trailing edge; at least one locating slot arranged above the trailing edge for fastening the stator vane on a casing or on an element of a gas turbine; means for reducing thermal and mechanical stresses in a region of transition between the trailing edge and the outer platform, the means for reducing being located on the outer platform of the stator vane, between the locating slot and the trailing edge of the vane airfoil.

A gas turbine is disclosed comprising: a stator vane having a vane airfoil which extends in a longitudinal direction of the stator vane and is delimited by a leading edge and a trailing edge; an outer platform, an inner side of which is positioned for exposure to turbine gas of the gas turbine, and on which at least one hook-like fastening element projects outwards in a region of the trailing edge; at least one locating slot arranged above the trailing edge for fastening the stator vane on a casing or on an element of the gas turbine; means for reducing thermal and mechanical stresses in a region of transition between the trailing edge and the outer platform, the means for reducing being located on outer platform of the stator vane, between the locating slot and the trailing edge of the vane airfoil.

A method for providing sequential combustion is disclosed, the method comprising: supplying a cooling medium to a gas turbine; and producing hot gas which flows through the gas turbine, wherein a vane airfoil extends in a longitudinal direction of a stator vane of the gas turbine and is delimited by a leading edge and a trailing edge; positioning an inner side of an outer platform for exposure to the hot gas of the gas turbine, at least one hook-like fastening element projecting outwards in a region of the trailing edge; arranging at least one locating slot above the trailing edge for fastening the stator vane on a casing or on an element of the gas turbine; and reducing thermal and mechanical stresses in a region of transition between the trailing edge and the outer platform, from a location on the outer platform of the stator vane, between the locating slot and the trailing edge of the vane airfoil.

BRIEF DESCRIPTION OF THE DRAWINGS

Aspects and advantages shall subsequently be explained in more detail based on exemplary embodiments in conjunction with the drawings. All elements which are not essential for the direct understanding of the embodiments have been omitted. Like elements are provided with the same designations in the different figures. The flow direction of the media is indicated by arrows. In the drawings.

Exemplary embodiments disclosed herein are directed to a stator vane, and an operational method, for gas turbines by which exceptionally small and purposeful modifications in design can provide a significantly improved service life.

On an outer platform of an exemplary stator vane, between a locating slot and a trailing edge, provision is made for means which can ensure a reduction of the thermal and mechanical stresses in a region of the transition between trailing edge and outer platform. As a result of this intervention directly on the outer platform in the region of the trailing edge, the thermal and mechanical loads with regard to the service life of the vane can be very simply and efficiently improved there with lasting effect.

According to an exemplary development, the outer platform in the region between trailing edge and locating slot has a reduced material thickness. As a result of this material reduction, the loads which are induced by thermal and mechanical stresses in this region can be efficiently minimized.

The means for reducing the thermal and mechanical stresses can, for example, comprise a cavity which is introduced into the outer platform between a locating slot and trailing edge, is arranged essentially (i.e., substantially) parallel to the inner side of the outer platform, and is oriented opposite a flow direction.

Furthermore, trailing edge of the vane can be formed in a set-back manner in the flow direction by a distance in relation to the fastening element.

A stator vane as disclosed herein can, for example, be used in a gas turbine.

Figure 1:
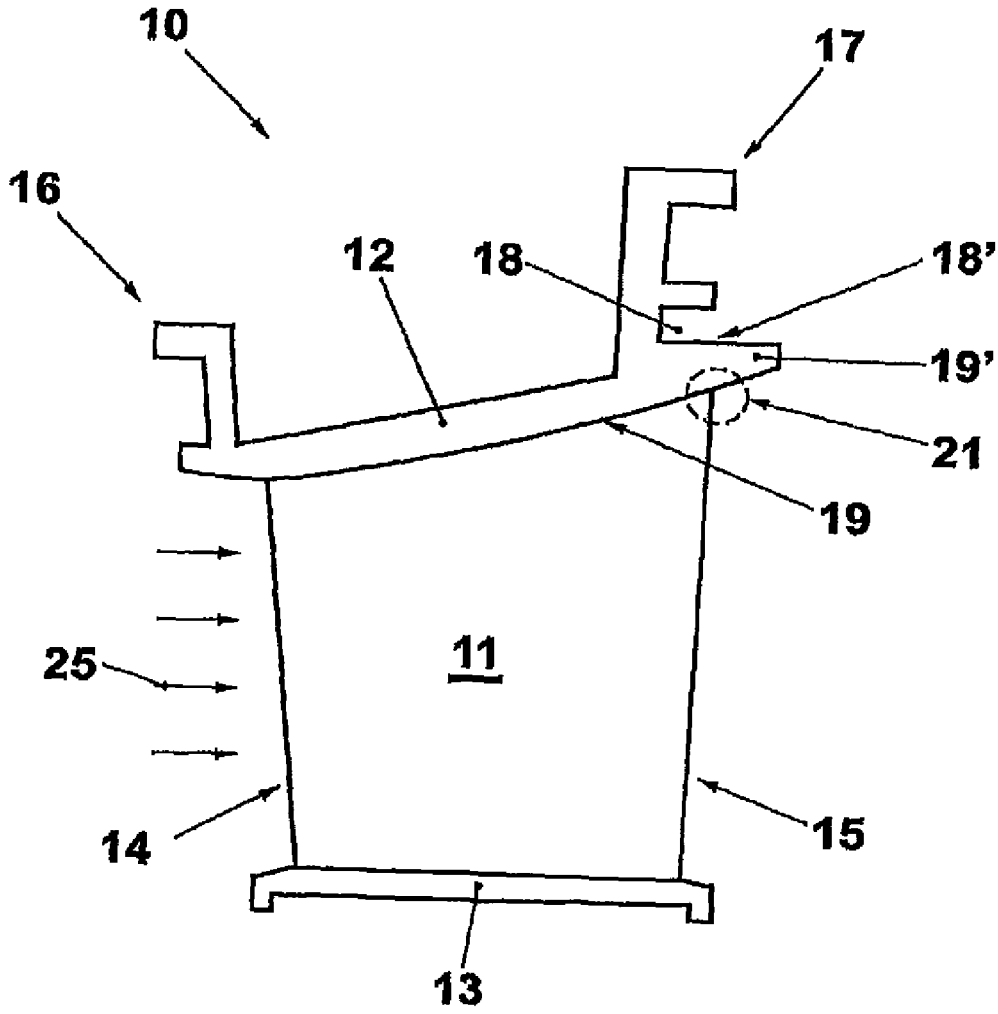
PRIOR ART FIG. 1
FIG. 1 shows in a side view a known stator vane, as has been installed in gas turbines.
Figure 2:
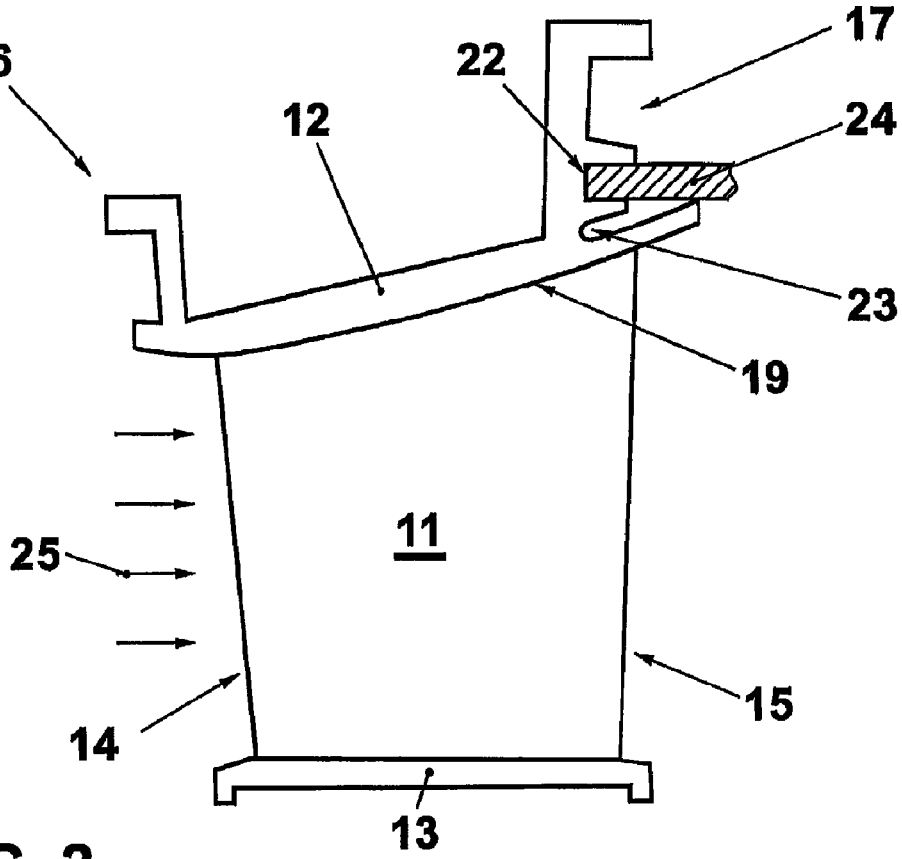
FIG. 2 shows in a view which is comparable to FIG. 1, a stator vane according to an exemplary embodiment.
Figure 3:
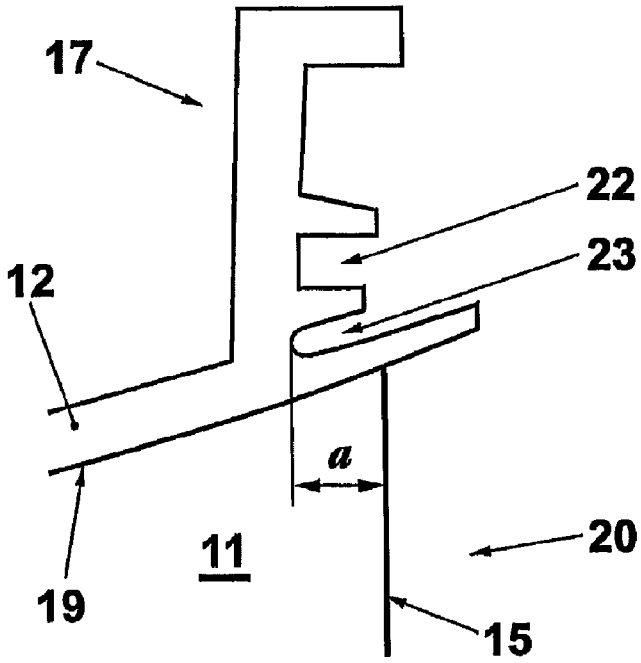
FIG. 3 shows an enlarged detail from FIG. 2 with an exemplary transition from a trailing edge of a vane airfoil to a rear fastening element of the stator vane.

FIGS. 2 and 3 show, in a view which is comparable to FIG. 1, a stator vane according to an exemplary embodiment. The stator vane 20 comprises a vane airfoil 11 with leading edge 14 and trailing edge 15, which is delimited in the longitudinal direction by a vane tip 13 and an outer platform 12. The outer platform 12 in this case also has an inner side 19 which is inclined at an angle in the outwards direction in the flow direction. Hook-like fastening elements 16 and 17 are again formed on the outer side of the outer platform 12, wherein a locating slot 22 for an adjoining heat shield 24 is formed on the rear fastening element 17 on the rear side.

For reducing the thermal and mechanical stresses between the trailing edge 15 of the vane airfoil 11 and the outer platform 12, provision is now made beneath the locating slot 22 for a cavity 23 which extends essentially (i.e., substantially) parallel to the inner side 19, which leads to a significant reduction of the thickness and therefore of the material volume of the outer platform 12 in the region above the trailing edge 15. At the same time, the trailing edge 15 is set back in the flow direction by a distance a (FIG. 3) in relation to the rear fastening element 17, as a result of which a further thermal and mechanical decoupling can be achieved.

Overall, exemplary embodiments and methods as disclosed herein can be characterized as follows:

A cavity 23, which can be optimized in its shape with regard to the thermal-mechanical matching between the outer platform 12 and the trailing edge 15, reduces the material volume above the trailing edge 15.

The cavity 23 can be arranged beneath the locating slot 22.

The trailing edge 15 can be set back in relation to the fastening element 17 in order to reduce the thermal stress at the critical transition between trailing edge and outer platform 12.

The cavity 23 can be dimensioned so that the reduction of the material volume above the trailing edge 15 entails no loss of strength during the intended use of the vane.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF DESIGNATIONS

10, 20 Stator vane (gas turbine)
11 Vane airfoil
12 Outer platform
13 Vane tip
14 Leading edge
15 Trailing edge
16, 17 Fastening element (hook-like)
18, 22 Locating slot (heat shield)
18' Base surface (locating slot)
19 Inner side (outer platform)
19' Wedge-shaped section
21 Transition (trailing edge to outer platform)
23 Cavity
24 Heat shield
25 Hot gas
a Distance

What is claimed is:

1. A stator vane for a gas turbine, which stator vane comprises:

a vane airfoil which extends in a longitudinal direction of the stator vane and is delimited by a leading edge and a trailing edge;

an outer platform, an inner side of which is positioned for exposure to turbine gas, and on which at least one hook-like fastening element projects outwards in a region of the trailing edge;

at least one locating slot arranged above the trailing edge for fastening the stator vane on a casing or on an element of a gas turbine;

means for reducing thermal and mechanical stresses in a region of transition between the trailing edge and the outer platform, the means for reducing being located on the outer platform of the stator vane, between the locating slot and the trailing edge of the vane airfoil; and wherein the trailing edge is set back in a turbine gas flow direction by a distance (a) in relation to the fastening element.

2. The stator vane as claimed in claim 1, wherein the locating slot is arranged above the means for reducing to fix a heat shield which adjoins the outer platform of the stator vane in a flow direction of turbine gas.

3. The stator vane as claimed in claim 1, wherein the means for reducing the thermal and mechanical stresses comprise:

the outer platform having a reduced thickness in a region between the trailing edge and the locating slot.

4. The stator vane as claimed in claim 3, wherein the means for reducing the thermal and mechanical stresses comprise:

a cavity introduced into the outer platform between locating slot and trailing edge at a location opposite a flow direction of turbine gas, wherein a progression of the cavity is formed substantially parallel to the inner side of the outer platform.

5. A gas turbine comprising:

a stator vane having a vane airfoil which extends in a longitudinal direction of the stator vane and is delimited by a leading edge and a trailing edge;

an outer platform, an inner side of which is positioned for exposure to turbine gas of the gas turbine, and on which at least one hook-like fastening element projects outwards in a region of the trailing edge;

at least one locating slot arranged above the trailing edge for fastening the stator vane on a casing or on an element of the gas turbine; and means for reducing thermal and mechanical stresses in a region of transition between the trailing edge and the outer platform, the means for reducing being located on the outer platform of the stator vane, between the locating slot and the trailing edge of the vane airfoil.

6. A method for providing sequential combustion, the method comprising:

supplying a cooling medium to a gas turbine; and producing hot gas which flows through the gas turbine, wherein a vane airfoil extends in a longitudinal direction of a stator vane of the gas turbine and is delimited by a leading edge and a trailing edge;

positioning an inner side of an outer platform for exposure to the hot gas of the gas turbine, at least one hook-like fastening element projecting outwards in a region of the trailing edge;

arranging at least one locating slot above the trailing edge for fastening the stator vane on a casing or on an element of the gas turbine; and reducing thermal and mechanical stresses in a region of transition between the trailing edge and the outer platform, from a location on the outer platform of the stator vane, between the locating slot and the trailing edge of the vane airfoil.

* * * * *